US011540567B2

(12) United States Patent
Sanders et al.

(10) Patent No.: US 11,540,567 B2
(45) Date of Patent: Jan. 3, 2023

(54) FILTER FRAME

(71) Applicant: JSP LIMITED, Witney (GB)

(72) Inventors: Stephen Francis Sanders, Witney (GB); Gavin Christopher Shaw, Witney (GB); Matthew Neal Judson, Witney (GB); Clive Johnstone, Witney (GB)

(73) Assignee: JSP Limited, Witney (GB)

( * ) Notice: Subject to any disclaimer, the term of this patent is extended or adjusted under 35 U.S.C. 154(b) by 515 days.

(21) Appl. No.: 16/605,128

(22) PCT Filed: Apr. 19, 2018

(86) PCT No.: PCT/GB2018/051024
§ 371 (c)(1),
(2) Date: Oct. 14, 2019

(87) PCT Pub. No.: WO2018/193255
PCT Pub. Date: Oct. 25, 2018

(65) Prior Publication Data

US 2021/0000200 A1 Jan. 7, 2021

(30) Foreign Application Priority Data

Apr. 19, 2017 (GB) ..... 1706199

(51) Int. Cl.
*A41D 13/11* (2006.01)
*A62B 7/10* (2006.01)
(Continued)

(52) U.S. Cl.
CPC ..... *A41D 13/1161* (2013.01); *A62B 7/10* (2013.01); *A62B 18/08* (2013.01); *A62B 23/02* (2013.01)

(58) Field of Classification Search
CPC .. A41D 13/1161; A41D 13/1107; A62B 7/10; A62B 7/00; A62B 18/08;
(Continued)

(56) References Cited

U.S. PATENT DOCUMENTS 6,016,804 A * 1/2000 Gleason ..... A62B 18/10 128/206.16
2008/0289632 A1 11/2008 Dankert et al.
(Continued)

FOREIGN PATENT DOCUMENTS

WO 2012100116 A1 7/2012
WO 2017087353 A1 5/2017

OTHER PUBLICATIONS

International Preliminary Report on Patentability issued in PCT/GB2018/051024, dated Oct. 31, 2019, 7 pages.
(Continued)

*Primary Examiner* — Joseph D. Boecker
*Assistant Examiner* — Brian T Khong
(74) *Attorney, Agent, or Firm* — Faegre Drinker Biddle & Reath LLP

(57) ABSTRACT

A disc filter frame including a base member and a lever, said base member including, adjacent a first end thereof, a breathing aperture and a connection arrangement configured to connect to a respiratory device, said breathing aperture and connection arrangement being aligned so as to define an airflow channel therebetween; said lever being hingedly connected by a hinge mechanism at its proximal end to said base at said first end and including a sealing member shaped and configured to cover said breathing aperture, the lever being biased in a first position and selectively movable to a second position in which said sealing member seals said breathing aperture, the distal end of said lever being located and spaced apart from adjacent a second, opposing end of
(Continued)

said base and configured to be manually pressed to move said sealing member from said first position to said second position.

31 Claims, 9 Drawing Sheets

(51) Int. Cl.
*A62B 18/08* (2006.01)
*A62B 23/02* (2006.01)

(58) Field of Classification Search
CPC ..... A62B 18/02; A62B 18/025; A62B 18/088; A62B 18/10; A62B 23/00; A62B 23/02; A62B 27/00
See application file for complete search history.

(56) References Cited

U.S. PATENT DOCUMENTS

| | | | | |
|---|---|---|---|---|
| 2013/0298512 | A1* | 11/2013 | Symons ..... | B01D 46/02 55/490 |
| 2015/0107596 | A1* | 4/2015 | Mashiko ..... | A62B 18/08 128/206.15 |
| 2015/0314147 | A1 | 11/2015 | Fleming et al. | |

OTHER PUBLICATIONS

International Search Report and Written Opinion issued in PCT/GB2018/051024, dated Jul. 23, 2018, 8 pages.

* cited by examiner

FILTER FRAME

CROSS-REFERENCE TO RELATED APPLICATION

This application is a U.S. 371 National Stage Application of International Application No. PCT/GB2018/051024, filed Apr. 19, 2018, which claims the benefit of Great Britain Application No. GB 1706199.5, filed Apr. 19, 2017, both of which are herein incorporated by reference in their entireties.

This invention relates generally to respiratory protection devices and, more particularly in one aspect, to a disc filter arrangement for use with a respiratory protective mask for protecting the wearer against harmful/irritant airborne particulates or substances.

Respiratory masks are used in a wide range of applications in which the air quality may be low, or in which hazardous/irritant substances or particulates may be in the air. Such applications may include, for example, construction, cleaning and decorating. In some industries, respiratory masks are a compulsory item of personal protection equipment (PPE), and users may be required to wear such devices for long periods of time. As such, where possible, there is an ongoing desire to minimise the weight and bulk of the filter cartridges attached to the mask. Disc filters, otherwise known as 'pancake' filters, are characteristically lighter in weight and less bulky than alternative cartridge-style filters, which naturally offers comfort benefits, particularly if a mask and filter set needs to be worn for long work time shifts. Whilst not always adequate for highly dirty environments, disc filters are considered to be a more 'disposable' form of filter that can be used for protection from mechanically and/or thermally generated particles, and which are designed to be of lower weight and profile to offer comfort and cost benefits.

WO2012/100116 describes a disc-filter frame which may be covered in a fibrous filter material and removably fixed to a respiratory mask. Referring to FIG. 1 of the drawings, there is shown a filter frame 100 comprising a lower half 104 and an upper half 106, connected at one end, and positioned on opposite sides of, a living hinge 102. The lower half 104 includes, at the opposite end to the hinge 102, a breathing tube 108 that can be configured to connect with a respirator (not shown) using one of a variety of connection arrangements (e.g. bayonet, thread, push fit, etc.). Thus, the breathing tube 108 is directly aligned with the breathing aperture in the mask at the location where the connection arrangement is operative. A negative pressure leak check may be performed by pressing down the upper half 106 along the direction of the arrow "D". By applying a light force to a sealing mechanism 118 positioned on the upper half 106, the user can selectively seal the breathing tube 108. This enables a user to check that the respiratory device and filter are correctly fitted for use. However, during the negative pressure leak check, or negative pressure fit check, the user must press the filter and mask against their face, which may cause the mask to move and create a false positive or negative fit check result.

Furthermore, a user may accidentally press the filter frame, thus accidentally operating the pressure fit check during normal use.

It is an object of aspects of the present invention to address at least some of these issues and, in accordance with a first aspect of the present invention, there is provided a disc filter frame comprising a base member and a lever, said base member including, adjacent a first end thereof, a breathing aperture and a connection arrangement configured to connect to a respiratory device, said breathing aperture and connection arrangement being aligned so as to define an airflow channel therebetween; said lever being hingedly connected by a hinge mechanism at its proximal end to said base at said first end and including a sealing member shaped and configured to cover said breathing aperture, the lever being biased in a first position in which a gap is defined between said sealing member and said breathing aperture, and selectively movable to a second position in which said sealing member seals said breathing aperture; the distal end of said lever being located and spaced apart from adjacent a second, opposing end of said base and configured to be manually pressed to move said sealing member from said first position to said second position.

According to one embodiment of the present invention, the hinge mechanism may comprise at least one foot, which forms from a downwardly extending generally 'L'-shaped protrusion, said base member having, located proximal said first end thereof, at least one aperture corresponding to said at least one foot, the base of said generally 'L'-shaped protrusion being larger in at least one dimension than the corresponding aperture.

Optionally, according to another embodiment of the present invention, the filter frame may further comprise a biasing member between the base member and the lever which is arranged and configured to exert a force between the base member and the lever and bias the lever in a first position. The biasing member may comprise an elastically deformable tab located between the base member and said lever, adjacent said distal end of the lever. The tab may be connected to, and extend at an angle from, the lever toward the base member.

According to one exemplary embodiment of the present invention, the sealing member may further comprise a layer of sealant material on a surface facing the breathing aperture, where the layer of sealant material may be shaped and configured to completely cover the breathing aperture when said lever is in said second position.

In one exemplary embodiment, the lever may be configured to be movable to the second position from the first position by a squeezing action by a user's finger and thumb, wherein said base member is pushed toward said lever and said lever is simultaneously pushed toward said base member.

Optionally, the base member and the lever may be constructed from rigid plastic material.

According to one exemplary embodiment of the present invention, the connection arrangement comprises a screw thread mechanism.

In one exemplary embodiment said breathing aperture is defined by a breathing tube comprising a circumferential wall extending around the periphery of said breathing aperture.

According to one exemplary embodiment of the present invention, the base member may define a recess at the second end, within which the distal end of the lever may be held such that a space is defined between the distal end of the lever and the base member to enable said lever to be moved from the first position to the second position. The recess may be defined by a pair of opposing, spaced apart walls extending substantially perpendicularly from the second end of the base member. Optionally, one or more stop members may be provided within the recess, extending inwardly from a respective one or more walls, and configured to retain said distal end of said lever within said recess.

In on exemplary embodiment, the base member may comprise a frame including cut-out portions around said breathing aperture.

According to a second aspect of the present invention, there is provided a filter comprising a filter frame as described above, and a fibrous casing shaped and configured to enclose said filter frame, said casing having an opening shaped and configured to fit around said connection arrangement, such that an airflow path is directed through the fibrous casing on one side of said filter frame, and through an unobstructed opening on the other side of said filter frame, in use.

In accordance with a third aspect of the present invention, there is provided a kit of parts comprising:

- a respiratory mask comprising a head strap and a face mask, said face mask having at least one opening; and
- a filter according to claim 15 configured to be connected over said opening, so as to define an air flow path, in use, from said mask through said fibrous casing.

These and other aspects of the present invention will be apparent from the following specific description, in which embodiments of the present invention are described, by way of examples only, and with reference to the accompanying drawings, in which.

According to an exemplary embodiment of the present invention, there is provided a disc- or 'pancake'-style filter frame, which has a small profile and is lightweight. In use the filter frame may be affixed to a single side of a respiratory mask, or two filter frames may be fixed either side of the respiratory mask. The frame would be enclosed in a pocket formed of fibrous material which filters particulates and harmful substances out of the air whilst the wearer breathes in and out.

Figure 1:
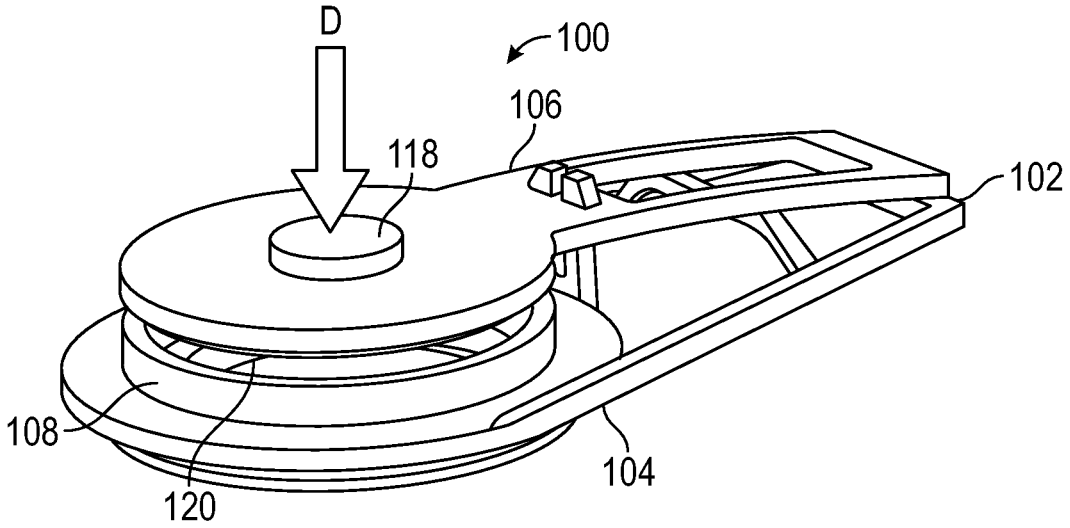
FIG. 1 PRIOR ART
FIG. 1 is a schematic perspective view of a disc filter according to the prior art.
Figure 2:
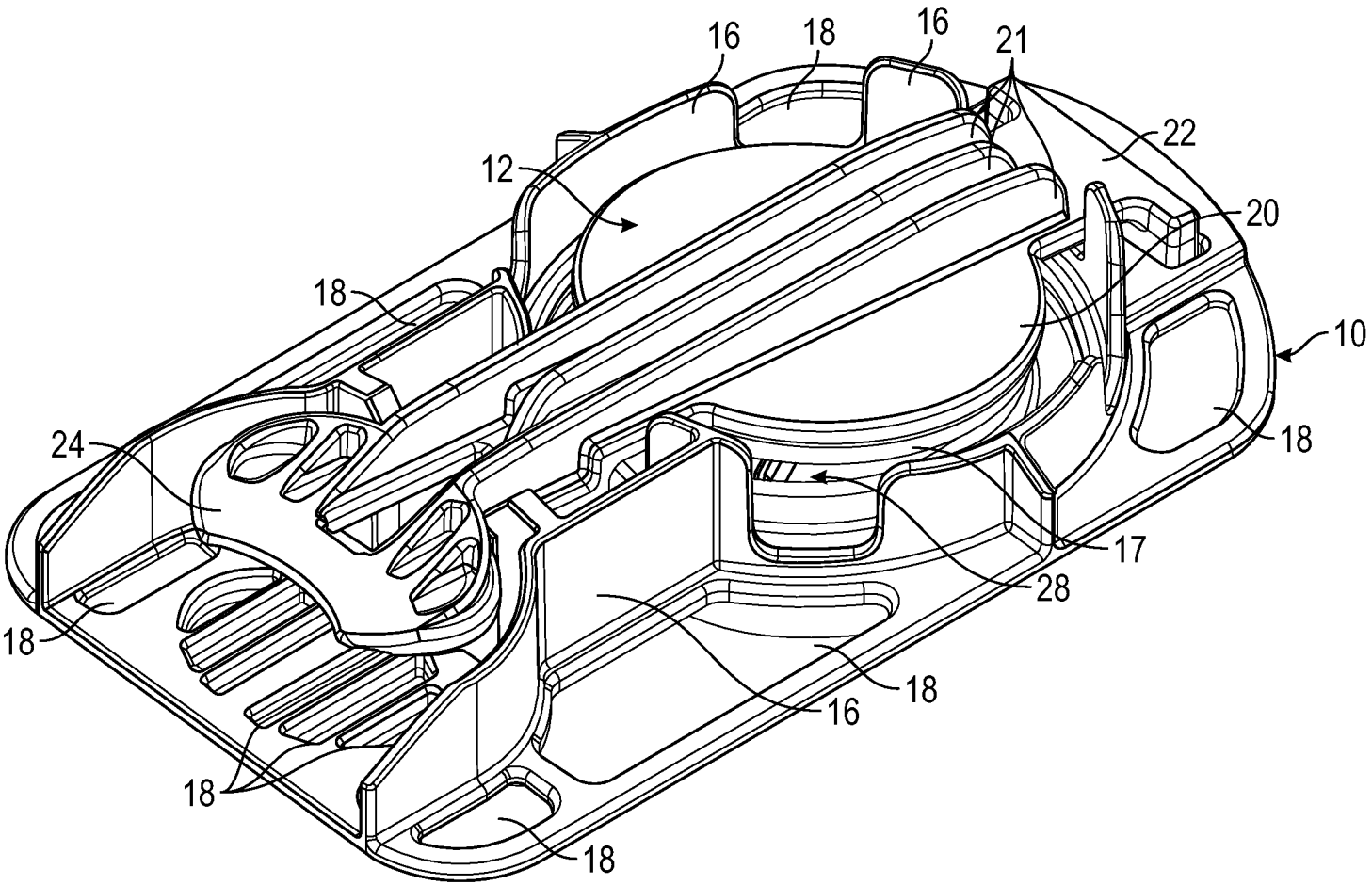
FIG. 2 is a schematic top-perspective view of a filter frame according to one exemplary embodiment of the present invention.
Figure 3:
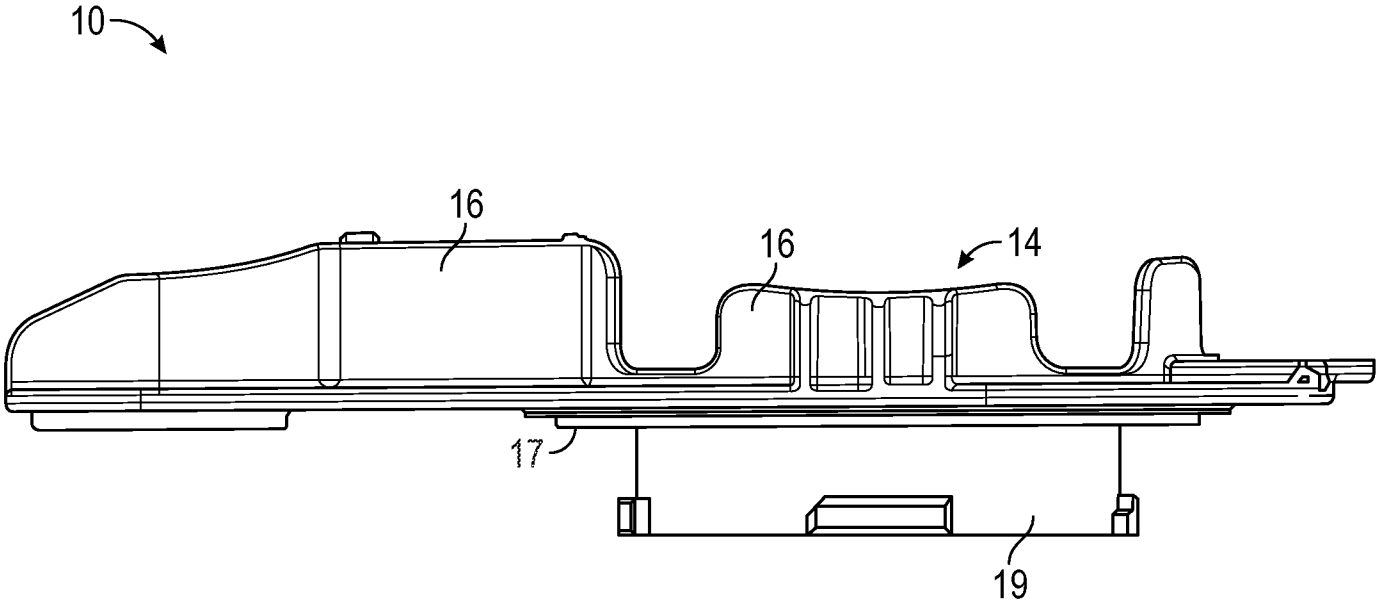
FIG. 3 is a schematic side view of the base of the filter frame of FIG. 2.

Referring to FIGS. 2 and 3 of the drawings, a two-part filter frame is provided comprising a base member 10 and a lever 12. The base member 10 is generally rectangular in shape, and having a rounded front end. The base member 10 comprises a circular breathing aperture 14 positioned proximal a first end of the generally rectangular base member 10. In use, this breathing aperture 14 defines a channel for air flow when the filter frame is affixed to a respiratory mask.

A wall 16 partially encloses the breathing aperture 14 by encircling round the breathing aperture 14 at the front end of the base member 10. The wall 16 can be seen best in FIG. 3 of the drawings. This wall 16 also runs partially along the length of the upper surface of the base member 10 of the device forming a protected corridor, or recess which runs centrally along the base member 10 between the breathing aperture 14 and a distal second end of the base member 10. As will be described in more detail later on, this recess or protected corridor is shaped and configured to accommodate the lever 12. The wall 16 is formed integrally with the base member 10, and the base member 10 is envisaged to be formed of a single piece of moulded plastic.

A connection arrangement 19 is provided on the underneath of the base member 10, situated directly in line with the breathing aperture 14. The connection arrangement 19 is shown to be a cylindrical protrusion extending outwardly from the underneath of the base member 10. The connection arrangement 19 is aligned with, and has a circumference just larger than, the circumference of the breathing aperture 14. The breathing aperture 14 extends all the way through the base member 10 and through the connection arrangement 19. The connection arrangement 19 may comprise a screw thread mechanism, or any other known rotational mechanisms for removable attachment of two parts. Such mechanisms will be well known in the art, and the invention is not intended to be limited in this regard. A strip of sealant material 17 surrounds the connection arrangement 19. The sealant material 17 may be made from pliable rubber material. In use, the connection arrangement 19 will be removably attached to a respiratory mask, the screw thread mechanism will force the mask and filter frame to be tightly connected, and the sealant material 17 will be compressed around the edge of where the mask joins the filter frame, filling any space which might be there and preventing any airflow. It will be understood by those skilled in the art that other suitable seals may be used, and the invention is not intended to be limited in this regard.

The base member 10 further comprises a plurality of cut-out portions 18, these are to reduce the overall weight of the device as a whole.

As can be seen best from FIG. 2 of the drawings, the lever 12 sits in the area surrounded by the wall 16. The lever 12 is narrower in width than the base member 10, and shorter in length. The lever 12 also is formed of a single piece of moulded plastic. It comprises an elongate body having a circular seal 20 long its length, an attachment means 22 for hingedly joining to the base member 10 at one end, and an actuator 24 at the other. The lever 12 also comprises ridges 21 on its upper surface, which run along the length of the member 12 and provide structural support. The lever 12 may be in one of two configurations, an open configuration and a closed configuration. The circular seal 20 is substantially larger in circumference than the breathing aperture 14 such that it can cover the breathing aperture 14 completely, when in the closed configuration. In the present exemplary embodiment, a circular piece of sealant material 17 is fixed to the underside of the circular seal 20.

In the open configuration, as the device is shown to be in FIG. 2 the circular seal 20 and the edge of the breathing aperture 14 are spaced apart from each other, forming a gap 28 therebetween. This gap 28 is precisely dimensioned so as to provide breathing pressures and resistance at the optimum comfort for the user, whilst maintaining the filtration function. In the closed configuration, the circular seal 20 is pressed down on to the edge of the breathing aperture 14. The sealant material 17 is deformed and fills any gaps which may have formed by, for example, uneven surfaces, preventing any airflow. In use, the wearer can move the device from the open configuration to the closed configuration in order to actuate a negative pressure fit check in that filter. Thus, the sealant material 17 prevents unwanted airflow during a negative pressure fit check which provides the user with a better accuracy of how the filter is performing.

Figure 4:
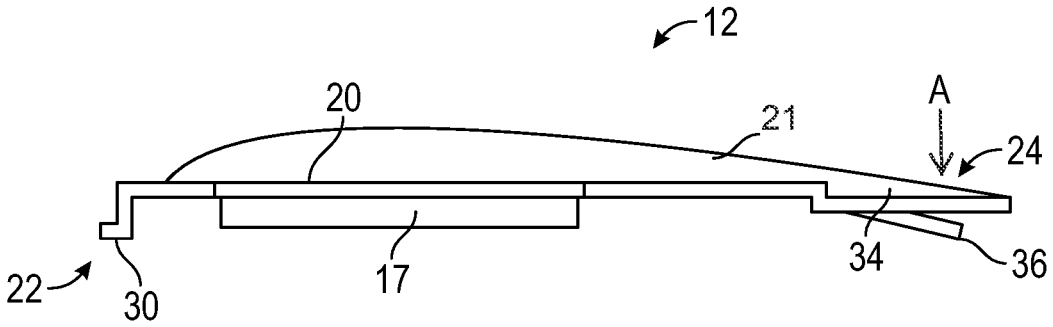
FIG. 4 is a schematic side view of the sealing member of the filter frame of FIG. 2.
Figure 5:
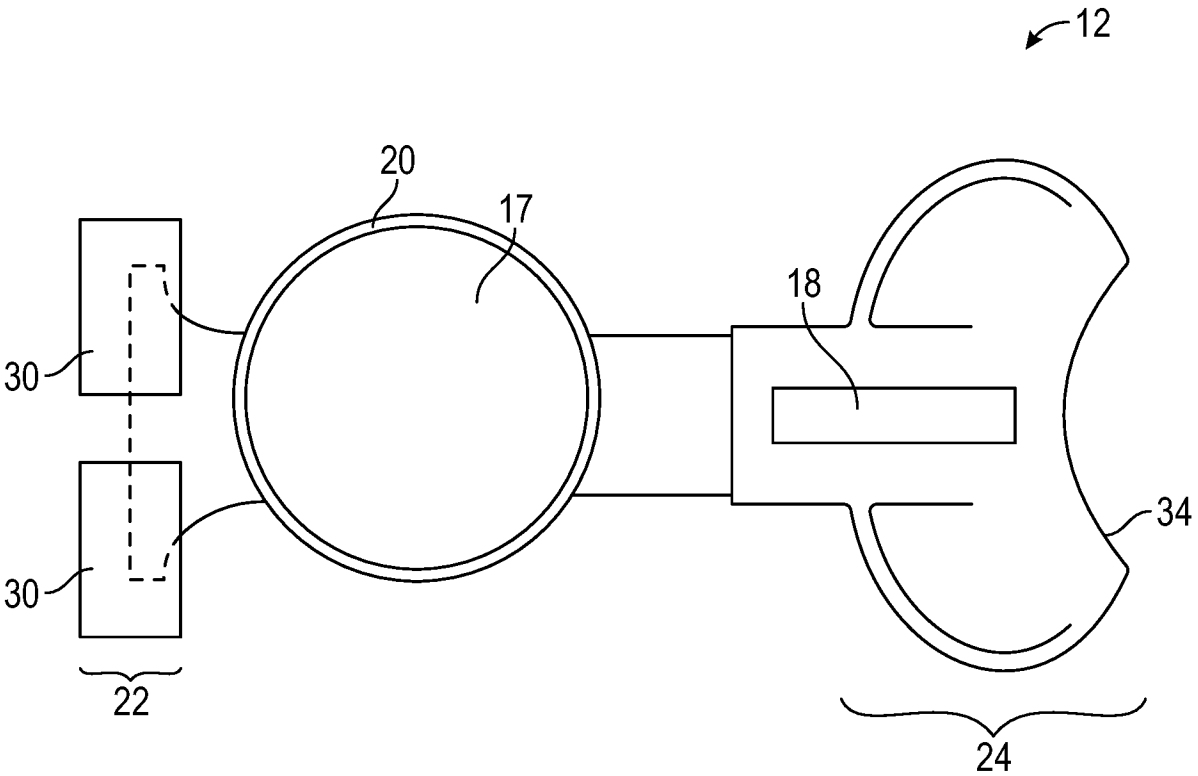
FIG. 5 is a schematic plan view of the underneath of the sealing member of the filter frame of FIG. 2.
Figure 6:
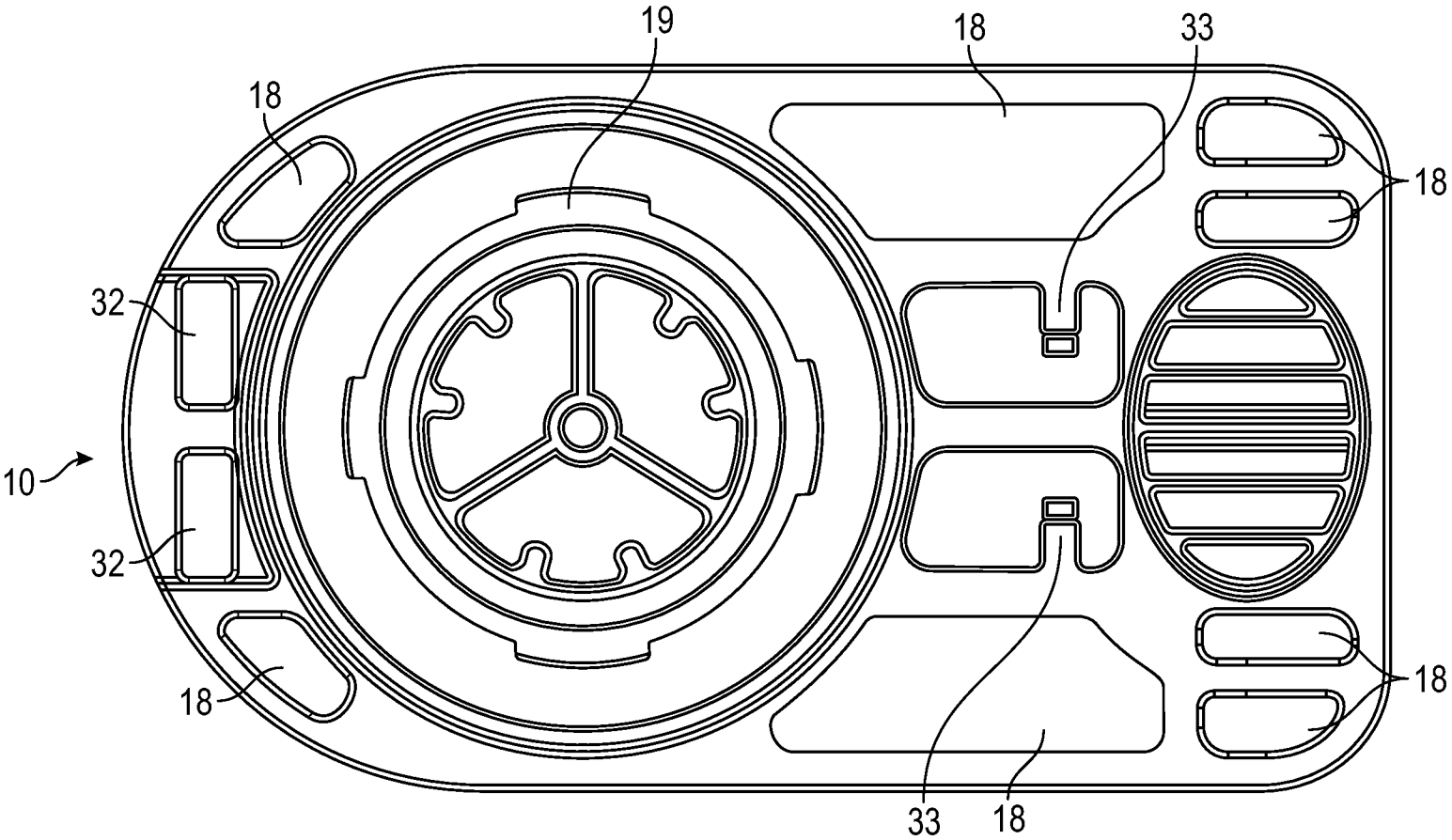
FIG. 6 is a schematic plan view of the underneath of the base of the filter frame of FIG. 2.
Figure 7:
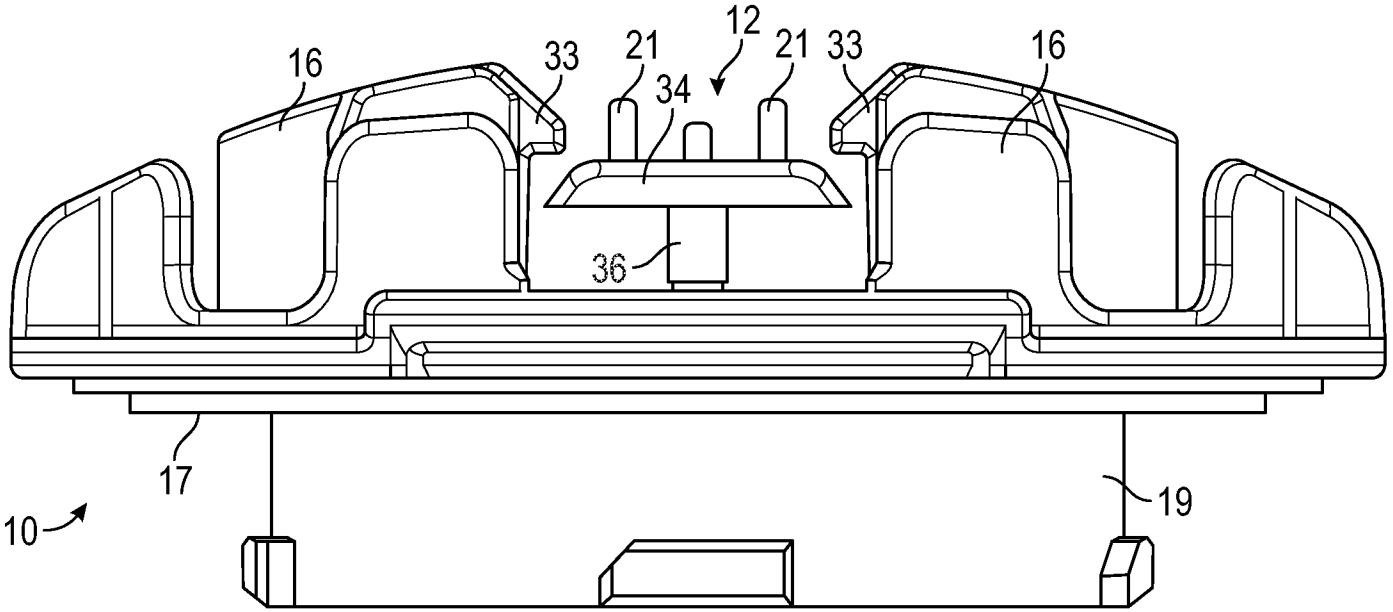
FIG. 7 is a schematic front-on end view of the filter frame of FIG. 2.

Referring specifically to FIGS. 4 and 5 of the drawings, the lever 12 is illustrated as would be seen from the side and underneath, respectively. At one end, the attachment means 22 can be seen. The attachment means 22 comprise two, generally 'L'-shaped feet 30, rectangular in shape, which extend parallel to and below the plane of the elongate body of the lever 12, and are spaced apart from each other. The two feet 30 can be inserted into two corresponding apertures 32 in the front end of the base member 10. Referring additionally to FIG. 6, the two corresponding apertures 32 are equal in length but narrower in width to the feet 30. In order to join the lever 12 and the base member 10, the feet 30 (and therefore the lever 12) must be inserted into apertures 32 substantially perpendicular to the plane of the base member 10. The lever 12 may then be brought down such that it is almost parallel with the base member 10, and in the position shown in FIG. 2. Because the feet 30 are wider than the apertures 32, the lever 12 and the base member 10 cannot easily separate. In use, the two parts will be enclosed in a pocket of fibrous material (130, FIGS. 8A and 8B), which will also act to prevent the lever 12 from lifting away from the base member 10 and reaching an angle at which it can separate. Referring additionally to FIG. 7 of the drawings, two inwardly protruding stopping members 33 further prevent the lever 12 from lifting away from the base member 10.

The actuator is indicated at 24, and comprises a 'fish-tail'-shaped end 34 which slopes out toward the end. A smooth sloped upper surface provides a platform upon which force may be directly applied in the direction of arrow 'A'. When the lever 12 and the base member 10 are joined together by the attachment means 22, application of force to the actuator 24 in the direction of arrow 'A' moves the filter frame from the open configuration to the closed configuration. In order to bias the lever 12 in the open configuration a biasing member 36 extends downwardly at an angle from the underneath of the shaped end 34. Biasing member 36 is comprised of a resiliently deformable material, such as plastic, and must be of a length such that, when the biasing member 36 is not flexed, it extends down below the plane of the sealant material 17 on the circular seal 20. This means that when the filter frame is in the open configuration, the biasing member 36 pushes the lever 12 upwardly and away from the base member 10 such that the sealant material 17 and top edge of the breathing aperture 14 are spaced apart forming a gap 28 in-between through which air can flow. The attachment means 22 keep the circular seal 20 and the breathing aperture 14 aligned.

When a force is applied to the 'fish-tail' shaped end 34 of the actuator 24, the biasing member 36 flexes toward the underneath of the actuator 24. This allows the sealant material 17 to be compressed between the circular seal 20 and the top edge of the breathing aperture 14. The filter frame is now in the closed configuration, whereby a negative pressure fit check can be performed.

The actuator 24 is positioned at the opposing end of the filter frame to where the breathing aperture 14 is located. This means that pressure can be applied in a squeezing motion, between a wearers thumb and forefinger, for example, in order to move the frame from the open configuration to the closed configuration. The force of this action is then not directed at all into the respiratory mask, allowing it to remain stable and in place whilst the negative pressure fit check takes place. This allows the wearer to conduct a more accurate negative pressure fit check.

The walls 16, extend upwardly from the base member 10 such that they protrude further from the base member 10 than any part of the lever 12, when the assembly is configured for use. The walls 16 provide a structure which prevents the wearer from accidentally operating a negative pressure fit check, and therefore the present invention provides a safer and more accurate way of performing a negative pressure fit check than the prior art. The raised walls 16 each side of the lever 12 are also precisely set to ensure the surrounding filter material does not catch and interfere with the lever 12 operation.

Figure 8A:
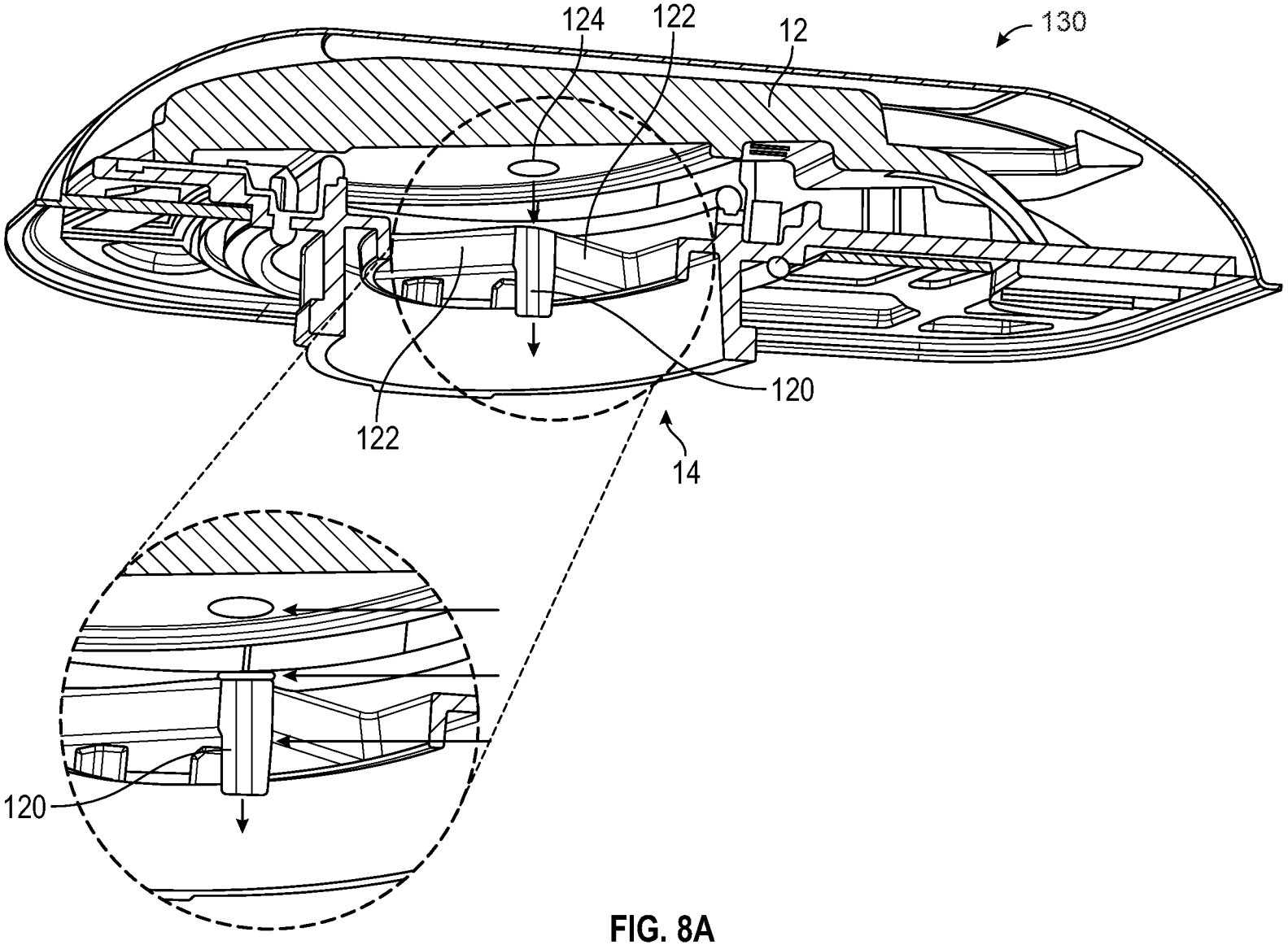
FIGS. 8A and 8B are schematic longitudinal cross-sectional views of a disc filter according to a second and third exemplary embodiment of the present invention.
Figure 8B:
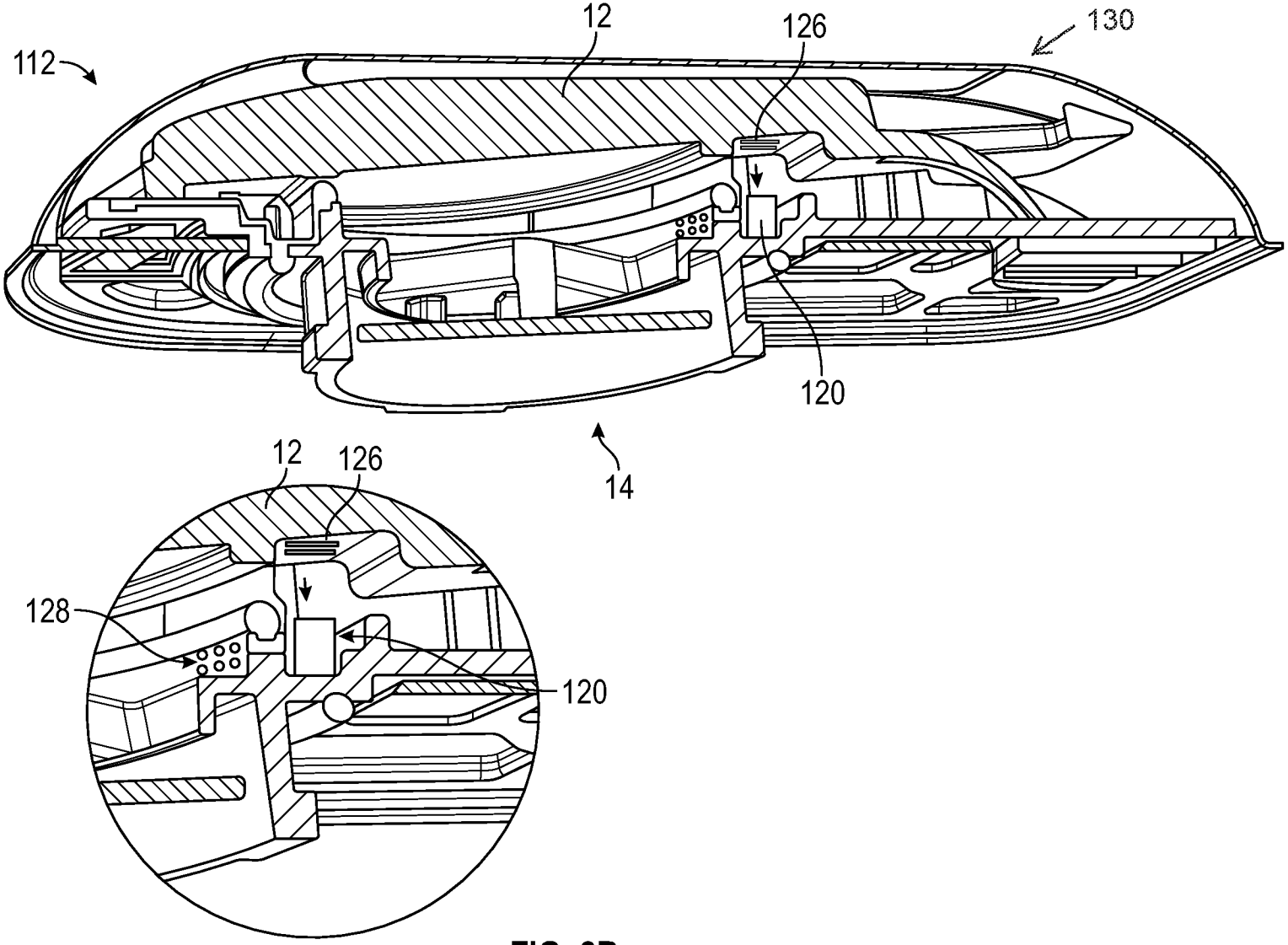

Optionally, and referring to FIGS. 8A and 8B of the drawings, in one exemplary embodiment of the invention, the filter frame 112 may further comprise a scent media 120 which is agitated when the negative pressure fit check is actuated. The scent media 120 could be in fabric form with a scented coating applied, or a small tablet/cube of fragranced material, however the invention is not intended to be limited in this regard. In the example shown in FIG. 8A, the scent media is present in the breathing aperture. Struts 122 extend inwardly from the edge of the breathing aperture and meet generally centrally. A scent channel through the central meeting point of the struts 122 allows scent particles to travel through from the scent media 120 to the user's olfactory senses. An engagement point 124 on the lever engages with and agitates the scent media 120 when the lever 12 is pressed. The scent media 120, when agitated, may release a distinctive scent (possible examples may include lemon, strawberry or mint) through the breathing aperture 14 of the disc filter.

Referring in particular to FIG. 8B, alternatively, the scent media 120 could be positioned between the lever and the filter frame. Surface texturing 126 on the lower surface of the lever engages with and agitates the scent media 120 when the lever is pressed. Small holes 128 provide a scent passage through the side of the breathing aperture 14.

This is particularly advantageous for a number of reasons, firstly, if a negative pressure fit check is actuated accidentally, the wearer is alerted straight away by the release of a scent. Secondly, the pleasant scent may encourage the wearer to perform a negative pressure fit check more regularly than they would if the scent were not there. This increases the chances of the wearer detecting a fault with their filter cartridge, and therefore increases their safety. Additionally, the scent media allows the wearer to introduce a level of personalisation to the product, by choosing the scented filters they prefer. Furthermore, research has indicated that wearers dislike the smell of rubber which comes with using respiratory masks which comprise filter assemblies, and so providing a more pleasant scent would make the respiratory masks themselves more appealing.

It will be apparent to a person skilled in the art, from the foregoing description that modifications and variations can be made to the described embodiments, without departing from the scope of the invention as defined by the appended claims.

The invention claimed is:

1. A disc filter frame comprising a base member and a lever, said base member including, adjacent a first end thereof, a breathing aperture and a connection arrangement configured to connect to a respiratory device, said breathing aperture and connection arrangement being aligned so as to define an airflow channel therebetween; said lever being hingedly connected by a hinge mechanism at its proximal end to said base member at said first end and including a sealing member shaped and configured to cover said breathing aperture, the lever being biased in a first position in which a gap is defined between said sealing member and said breathing aperture, and selectively movable to a second position in which said sealing member seals said breathing aperture; a distal end of said lever being located and spaced apart from a second, opposing end of said base member and configured to be manually pressed to move said sealing member from said first position to said second position;

wherein said hinge mechanism comprises at least one foot formed from a downwardly extending generally 'L'-shaped protrusion, said base member having, located proximal said first end thereof, at least one aperture corresponding to said at least one foot, the base of said generally 'L'-shaped protrusion being larger in at least one dimension than said corresponding aperture.

2. A filter frame according to claim 1, wherein said filter frame further comprises a biasing member between said base member and said lever which is arranged and configured to exert a force between said base member and said lever and bias said lever in said first position.

3. A filter frame according to claim 2, wherein said biasing member comprises an elastically deformable tab located between said base member and said lever, adjacent said distal end of said lever.

4. A filter frame according to claim 3, wherein said tab is connected to, and extends at an angle from, said lever toward said base member.

5. A filter frame according to claim 1, wherein said sealing member further comprises a layer of sealant material on a surface facing said breathing aperture, said layer of sealant material being shaped and configured to completely cover said breathing aperture when said lever is in said second position.

6. A filter frame according to claim 1, wherein said lever is configured to be moveable to said second position from said first position by a squeezing action by a user's finger and thumb, wherein said base member is pushed toward said lever and said lever is simultaneously pushed toward said base member.

7. A filter frame according to claim 1, wherein said base member and said lever are constructed from rigid plastic material.

8. A filter frame according to claim 1, wherein said connection arrangement comprises a screw thread mechanism.

9. A filter frame according to claim 1, wherein said breathing aperture is defined by a breathing tube comprising a circumferential wall extending around the periphery of said breathing aperture.

10. A filter frame according to claim 1, wherein said base member defines a recess at said second end, within which said distal end of said lever is held such that a space is defined between said distal end of said lever and the base member to enable said lever to be moved from said first position to said second position.

11. A filter frame according to claim 10, wherein said recess is defined by a pair of opposing, spaced apart walls extending substantially perpendicularly from said second end of said base member.

12. A filter frame according to claim 11, wherein one or more stop members is provided within said recess, extending inwardly from a respective one or more walls, and configured to retain said distal end of said lever within said recess.

13. A filter frame according to claim 1, wherein the base member comprises a frame including cut-out portions around said breathing aperture.

14. A filter frame according to claim 1, further comprising a scent media which is agitated when said sealing member is in said second position, said scent media being configured to release scent particles into said channel for airflow when agitated.

15. A filter comprising a filter frame according to claim 1, and a fibrous casing shaped and configured to enclose said filter frame, said casing having an opening shaped and configured to fit around said connection arrangement, such that an airflow path is directed through the fibrous casing on one side of said filter frame, and through an unobstructed opening comprising said breathing aperture on the other side of said filter frame, in use.

16. A kit of parts comprising:

a respiratory mask comprising a head strap and a face mask, said face mask having at least one opening; and a filter according to claim 15 configured to be connected over said at least one opening, so as to define an air flow path, in use, from said mask through said fibrous casing.

17. A disc filter frame comprising a base member and a lever, said base member including, adjacent a first end thereof, a breathing aperture and a connection arrangement configured to connect to a respiratory device, said breathing aperture and connection arrangement being aligned so as to define an airflow channel therebetween; said lever being hingedly connected by a hinge mechanism at its proximal end to said base member at said first end and including a sealing member shaped and configured to cover said breathing aperture, the lever being biased in a first position in which a gap is defined between said sealing member and said breathing aperture, and selectively movable to a second position in which said sealing member seals said breathing aperture; the distal end of said lever being located and spaced apart from a second, opposing end of said base member and configured to be manually pressed to move said sealing member from said first position to said second position;

wherein said filter frame further comprises a biasing member between said base member and said lever which is arranged and configured to exert a force between said base member and said lever and bias said lever in said first position; and wherein said biasing member comprises an elastically deformable tab located between said base member and said lever, adjacent said distal end of said lever.

18. A filter frame according to claim 17, wherein said hinge mechanism comprises at least one foot formed from a downwardly extending generally 'L'-shaped protrusion, said base member having, located proximal said first end thereof, at least one aperture corresponding to said at least one foot, the base of said generally 'L'-shaped protrusion being larger in at least one dimension than said corresponding aperture.

19. A filter frame according to claim 17, wherein said tab is connected to, and extends at an angle from, said lever toward said base member.

20. A filter frame according to claim 17, wherein said sealing member further comprises a layer of sealant material on a surface facing said breathing aperture, said layer of sealant material being shaped and configured to completely cover said breathing aperture when said lever is in said second position.

21. A filter frame according to claim 17, wherein said lever is configured to be movable to said second position from said first position by a squeezing action by a user's finger and thumb, wherein said base member is pushed toward said lever and said lever is simultaneously pushed toward said base member.

22. A filter frame according to claim 17, wherein said base member and said lever are constructed from rigid plastic material.

23. A filter frame according to claim 17, wherein said connection arrangement comprises a screw thread mechanism.

24. A filter frame according to claim 17, wherein said breathing aperture is defined by a breathing tube comprising a circumferential wall extending around the periphery of said breathing aperture.

25. A filter frame according to claim 17, wherein said base member defines a recess at said second end, within which said distal end of said lever is held such that a space is defined between said distal end of said lever and the base member to enable said lever to be moved from said first position to said second position.

26. A filter frame according to claim 25, wherein said recess is defined by a pair of opposing, spaced apart walls extending substantially perpendicularly from said second end of said base member.

27. A filter frame according to claim 26, wherein one or more stop members is provided within said recess, extending inwardly from a respective one or more walls, and configured to retain said distal end of said lever within said recess.

28. A filter frame according to claim 17, wherein the base member comprises a frame including cut-out portions around said breathing aperture.

29. A filter frame according to claim 17, further comprising a scent media which is agitated when said sealing member is in said second position, said scent media being configured to release scent particles into said channel for airflow when agitated.

30. A filter comprising a filter frame according to claim 17, and a fibrous casing shaped and configured to enclose said filter frame, said casing having an opening shaped and configured to fit around said connection arrangement, such that an airflow path is directed through the fibrous casing on one side of said filter frame, and through an unobstructed opening comprising the breathing aperture on the other side of said filter frame, in use.

31. A kit of parts comprising:

a respiratory mask comprising a head strap and a face mask, said face mask having at least one opening; and a filter according to claim 30 configured to be connected over said opening, so as to define an air flow path, in use, from said mask through said fibrous casing.

* * * * *